US006390765B1

(12) United States Patent
Dick

(10) Patent No.: US 6,390,765 B1
(45) Date of Patent: May 21, 2002

(54) POWER LATCHED QUICK CHANGE ATTACHMENT COUPLER FOR SKID STEER VEHICLES

(76) Inventor: Dennis J Dick, 5541 Ridge Ave. SW., East Sparta, OH (US) 44626

( * ) Notice: Subject to any disclaimer, the term of this patent is extended or adjusted under 35 U.S.C. 154(b) by 0 days.

(21) Appl. No.: 09/546,091

(22) Filed: Apr. 10, 2000

(51) Int. Cl.[7] ..... B66C 23/00
(52) U.S. Cl. ..... 414/723; 37/468; 403/322.3
(58) Field of Search ..... 414/723; 37/468; 403/322.3

(56) References Cited

U.S. PATENT DOCUMENTS

| | | | | | |
|---|---|---|---|---|---|
| 3,269,570 | A | | 8/1966 | Wallberg | 214/131 |
| 3,672,521 | A | | 6/1972 | Bauer et al. | 214/145 |
| 3,732,996 | A | | 5/1973 | Bauer | 214/152 |
| 5,010,962 | A | * | 4/1991 | Bloom, Jr. | 414/723 X |
| 5,098,252 | A | | 3/1992 | Sheesley et al. | 414/723 |
| 5,107,610 | A | | 4/1992 | Fusco | 37/103 |
| 5,147,173 | A | * | 9/1992 | Fauber et al. | 414/723 |
| 5,403,144 | A | * | 4/1995 | Staben, Jr. | 414/723 X |
| 5,562,397 | A | | 10/1996 | Albright | 414/723 |
| 5,692,855 | A | * | 12/1997 | Burton | 414/723 X |
| 5,967,738 | A | * | 10/1999 | Warthold | 414/723 |

* cited by examiner

*Primary Examiner*—Donald W. Underwood
(74) *Attorney, Agent, or Firm*—Paul E Milliken; Ray L Weber

(57) ABSTRACT

A power operated apparatus to latch an attachment to a loader arm of a skid steer vehicle having an attachment frame with a pair of spaced apart latch pins slidably mounted on the frame to move between a latched and an unlatched position to either lock in place or release a loader attachment to the attachment frame. Each latch pin is operatively connected to an axially slidable piston rod of a hydraulic actuator which moves the latch pin between a latched and an unlatched position in response to manipulation of controls by an operator in the vehicle cab.

22 Claims, 5 Drawing Sheets

POWER LATCHED QUICK CHANGE ATTACHMENT COUPLER FOR SKID STEER VEHICLES

FIELD OF THE INVENTION

This invention relates to power actuated quick attachment devices for accessories or work implements on skid steer vehicles, to eliminate hand operated latches on such attachment devices.

BACKGROUND OF THE INVENTION

In the past various quick attachment devices have been developed for skid steer loaders. U.S. Pat. Nos. 3,732,996 and 3,672,521 show quick attachment devices that are carried on the front of a loader arm and are used for quickly attaching and detaching various accessories, such as different types of buckets or grapples. These quick attachment devices have been utilized extensively by Melroe Company, a Business Unit of Clark Equipment Company and sold under the trade name BOBTACH.

Power operated, quick attachment devices have been also advanced in the past, such as the device shown in U.S. Pat. No. 3,269,570. Also a power operated device for backhoes is illustrated in U.S. Pat. No. 5,107,610.

A skid steer loader adapter for an implement mounting plate is shown in U.S. Pat. No. 5,098,252 and uses a spring biased mechanism that is biased toward a retracted or released position. An over center wedging mechanism engages hook members to overcome a spring force and the locking mechanism is forced into engagement with the implement being mounted.

U.S. Pat. No. 5,562,397 shows a way of adapting the BOBTACH system to power operation by attaching a power actuator between an existing pair of hand levers which move a respective pair of latch pins or wedge members to a retracted or an extended position. The power actuator is retracted or extended between the hand levers to move them into position to retract or extend the latch pins.

The present invention simplifies the assembly by reducing the number of working parts and eliminates the hand levers by connecting a power actuator directly to each latch pin. In addition cover members are provided for all the working parts of the latch pins and actuators to prevent dirt and debris from clogging up the equipment and interfering with reliable operation of the latch pins.

SUMMARY OF THE INVENTION

This invention relates to a power operated apparatus to latch an attachment to a loader arm of a skid steer vehicle comprising: an attachment frame including at least one latch slidably attached thereto and which slidably moves to a latched position to hold an implement on the attachment frame and at least one power operated actuator having a fixed portion attached to the attachment frame and an elongated moveable portion having one end slidably engaging the fixed portion and an opposite end attached to the latch to cause the latch to move to either a latched or unlatched position depending upon the direction of movement of the moveable portion, a power source associated with the actuator causing sliding movement of the moveable portion to an extended or retracted position with respect to the fixed portion and control means to regulate power provided to the actuator.

DESCRIPTION OF THE PREFERRED EMBODIMENTS

Figure 2:
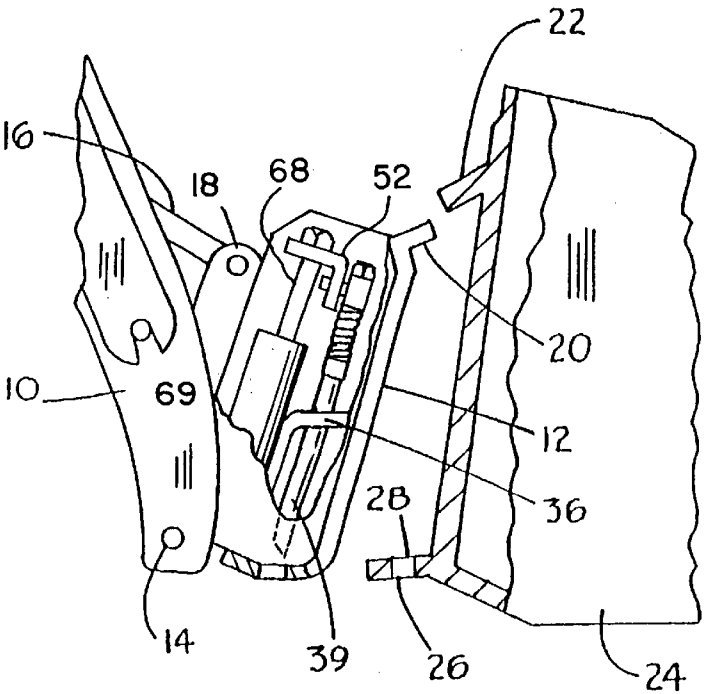
FIG. 2 is a side elevational view of a typical quick attachment system with which the power actuator of the present invention is used showing an attachment prior to being positioned on a mounting plate on loader arms of a skid steer vehicle.

As shown in FIG. 2, a loader arm 10 of conventional construction has an attachment mounting plate 12 pivotally mounted on the arm about pivots 14. The tilting of the attachment plate 12 is controlled by an actuator, the extensible and retractable rod of which is shown as 16, attached to a suitable bracket 18 on the attachment mounting plate 12. As can be seen in FIG. 2, the attachment mounting plate 12 includes a lip 20 that will fit under a flange 22 on an attachment such as a loader bucket indicated at 24. There is a flange on the lower edge of the back wall on each side of the bucket. One side of the attachment plate is shown for sake of illustration. A lower flange 26 is also supported on the attachment or bucket 24, and as can be seen the lower flange 26 has an aperture 28 that will align with an aperture 30 in a lower support flange 32 of the attachment mounting plate or frame 12. A sliding latch pin or wedge 34 is mounted in a suitable guide plate (or plates) 36 that forms part of a latch pin and actuator housing 37 on the attachment mounting plate 12. The latch pin 34 will move up or down in a vertical direction. As can be seen, the latch pin has a tapered wedge end 38, to aid in pushing the wedge or latch pin 34 into the desired aperture on the attachment or bucket 24 when it is in position to be mounted. The latch pin 34 also has a shaft portion 39 that is slidably guided in suitable guides.

Figure 6:
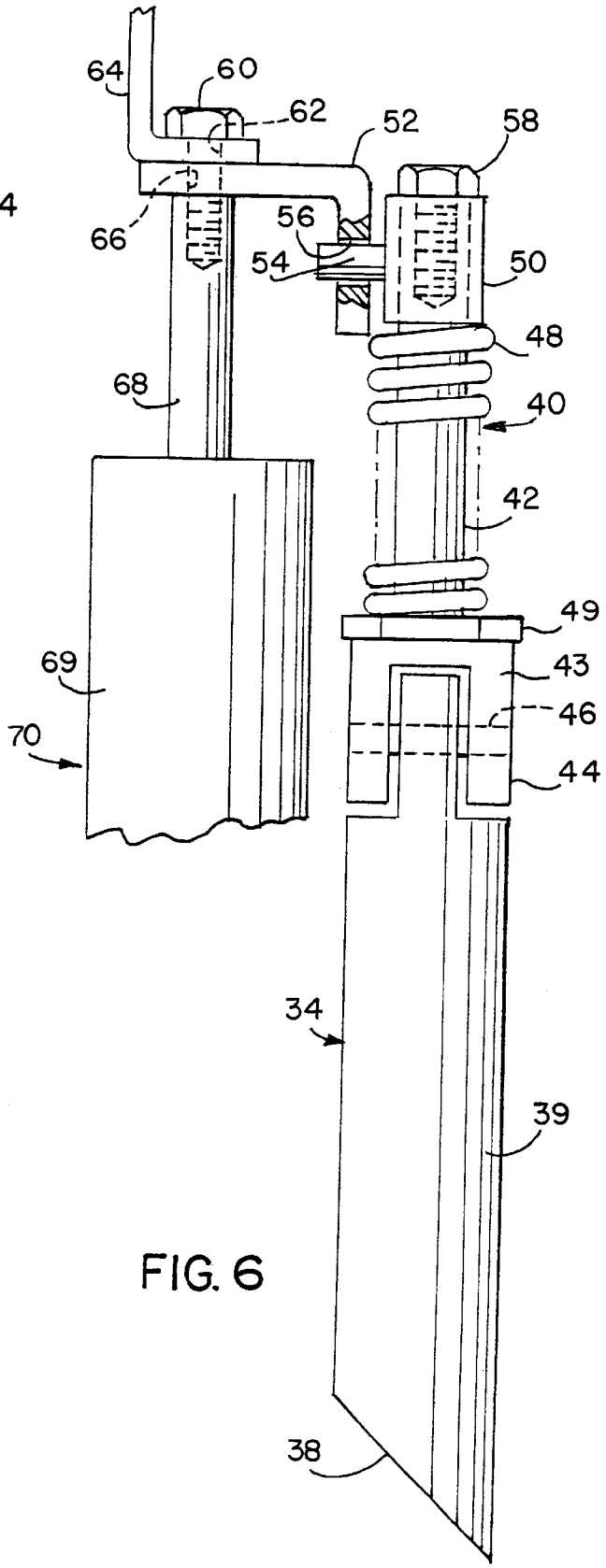
FIG. 6 is a greatly enlarged view of the latch pin assembly attached to a piston rod of a power actuator.

As best seen in FIG. 6, the upper end of shaft portion 39 of latch pin 34 is pivotally mounted to a conventional latch pin actuator shaft assembly 40, which has a housing 43 at the lower end. The housing 43 has a bifurcated end 44 that receives a pivot pin 46 used for coupling the housing 43 to the end of shaft portion 39 of latch pin 34.

A coupling end 50 is connected to a shaft member 42 that is slidably coupled to the housing 43. A spring 48 acts between an adjusting nut 49 and coupling end 50 at the upper end of the telescoping shaft assembly 40. The arrangement is conventional and will load the latch pin or wedge downward to lock the latch pin as well as upward.

The upper ends of each of the shaft assemblies 40 are each connected to an L-shaped bracket 52 respectively on opposite sides of the attachment mounting plate 12. The shaft assemblies 40 and the latch pins are identical on the opposite sides of the attachment mounting plate 12. The coupling end 50 on each latch pin carries a pivot pin 54 which passes through a hole 56 in the bracket 52 and enables each bracket 52 to pivotally engage the latch pin 34. A bolt 58 holds the coupling end 50 in position on the end of the shaft member 42.

A bolt 60 passes through a hole 62 in a latch pin position indicator 64 and a hole 66 in the bracket 52 and attaches both the bracket 52 and the indicator 64 to the end of a piston rod 68 protruding from a hydraulic cylinder 69 of a hydraulic actuator 70. The hydraulice cylinder 69 is fixedly attached to the attachment mounting plate 12 by blocks 71. Instead of blocks brackets could also be used.

Figure 8:
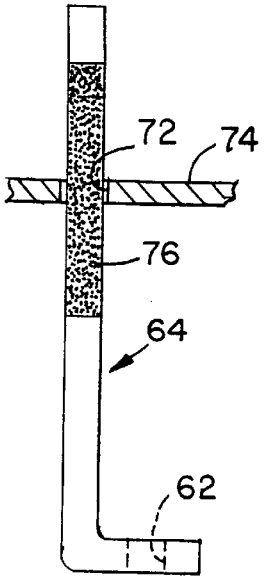
FIG. 8 is a side elevational view showing a latch position indicator flag which is attached to a piston rod as shown in FIG. 6.
Figure 7:
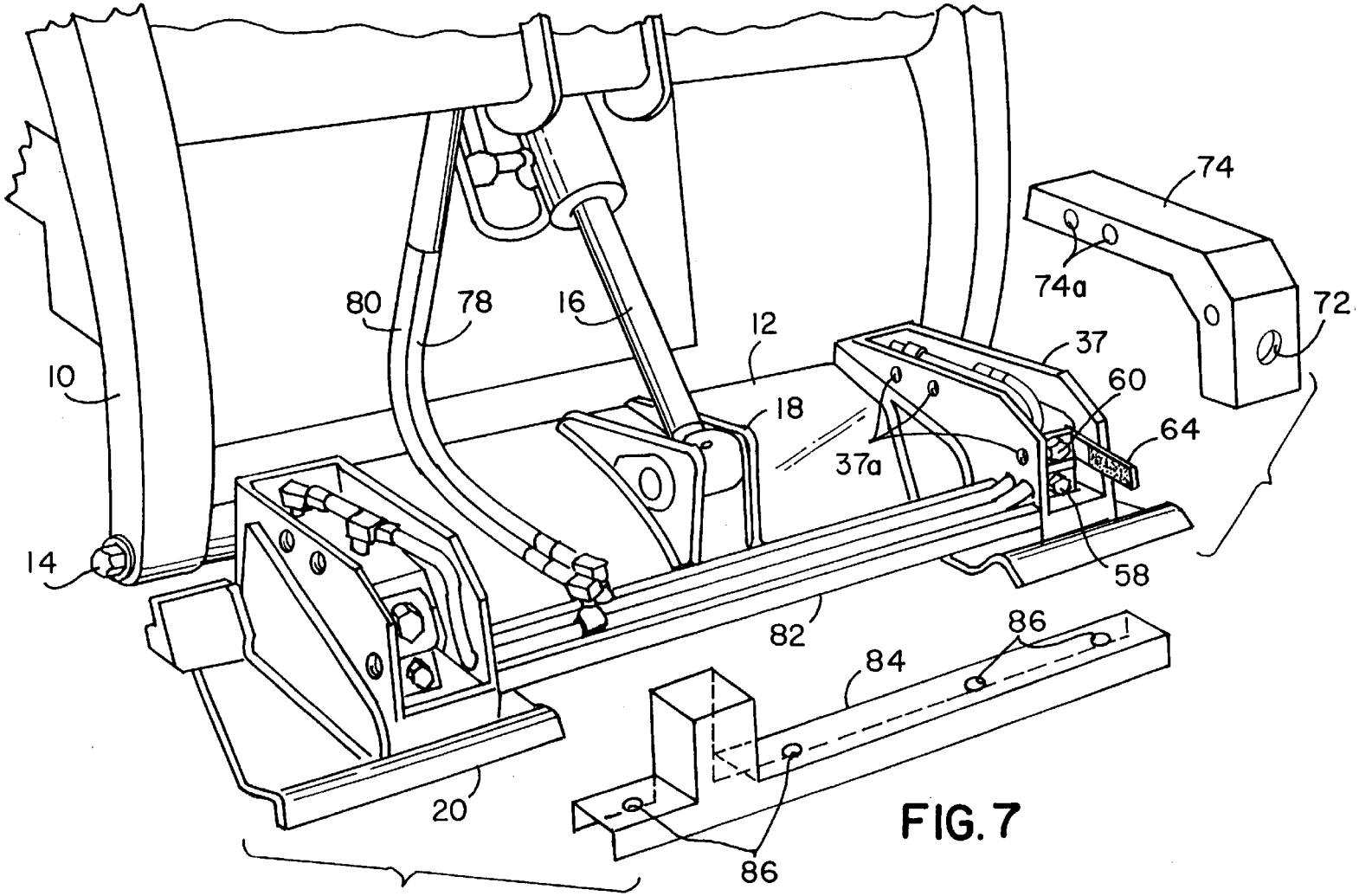
FIG. 7 is a perspective view of the attachment plate pivoted down into a horizontal position to show how the cover members fit on the attachment plate to enclose the moving parts of the actuators and latch pins for protection from dirt and debris.

The entire indicator 64 is shown in FIG. 8 in which it is shown projecting through an opening 72 in a cover member 74 which is shown in its entirety in FIG. 7. The cover member 74 has holes 74*a* through which bolts (not shown) pass and are attached to matching threaded holes 37*a* in the actuator housing 37. A shaded portion 72 of the length of the indicator 64 (indicated by stippling) may be painted a bright color such as orange or red to make it readily visible when it is protruding through the opening 72. When the piston rod 68 moves to an extended position to raise the latch pin 34 to an unlatched position, this also moves the indicator 64 so that the bright colored portion 76 is visible on the outside of the cover 74. When the piston rod 68 is retracted, the latch pin 34 is moved to a latched position and the bright colored portion 76 is moved inside the cover 74 and is no longer visible. This indicates to the operator of the vehicle that the latch pin is in the latched or engaged position to hold an attachment on the attachment mounting plate. For simplicity of the drawings, the indicators 64 have only been shown on FIGS. 6 through 8. In can be seen that this indicators 64 can also be attached to the piston rods 68 shown on all the other figures of the drawings.

Figure 1:
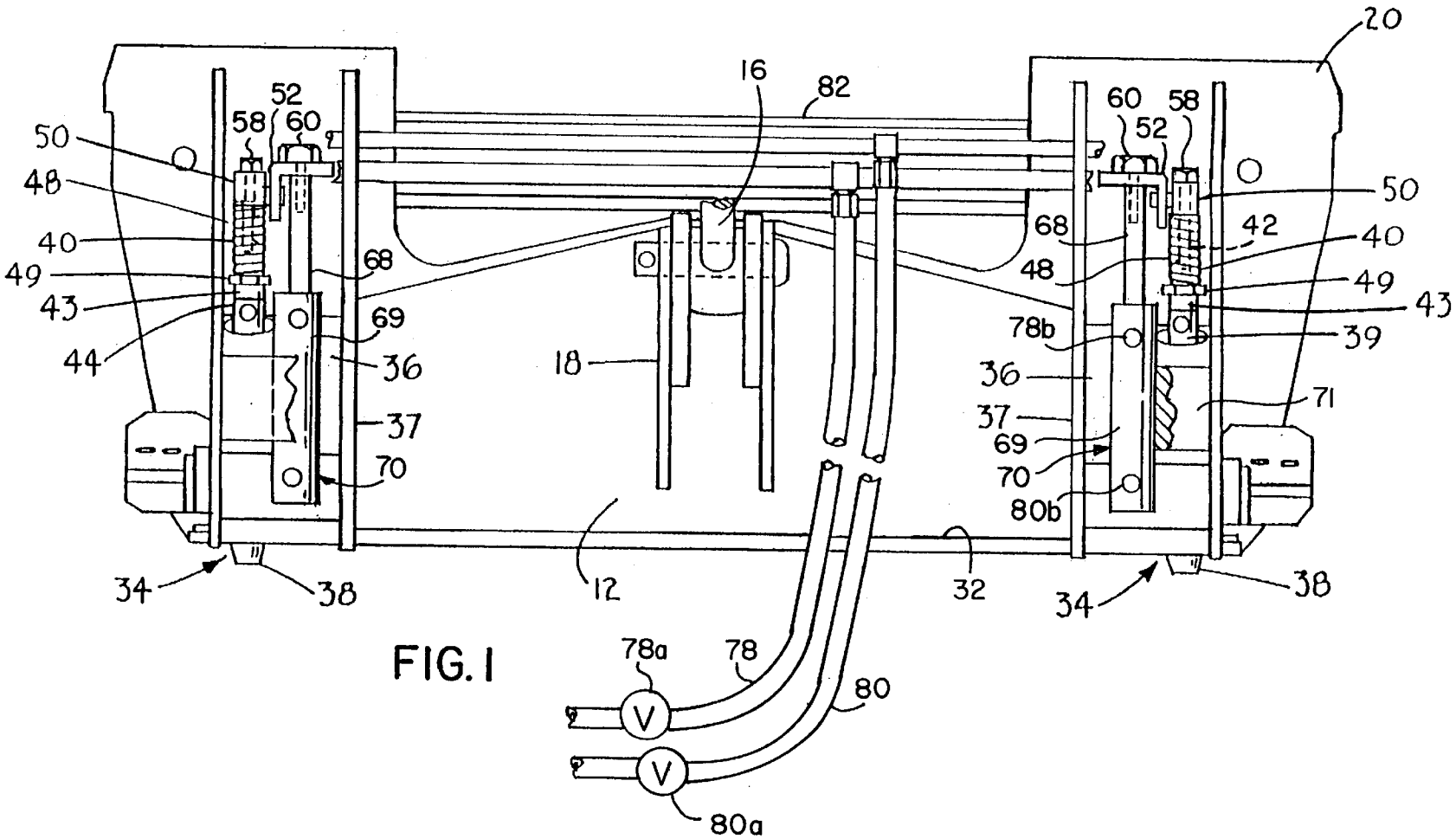
FIG. 1 is an elevational view of an attachment plate having power actuators for moving latch pins in a longitudinal direction.

As shown in FIG. 1 hydraulic lines 78 and 80 are controlled by valves 78*a* and 80*a* respectively to regulate the flow of hydraulic fluid pressure to the actuators 69. Suitable controls for the valves can be located in the operators cab of the vehicle. Each of the lines 78 and 80 divides off and runs through a transverse channel 82 to supply fluid to both the cylinders 69. For simplicity of the drawing the lines 78 and 80 are not shown connected to the cylinders 71 of the actuators 70, however in operation, line 78 connects to ports 78*b* to cause retraction of piston rods 68 and line 80 connects to ports 80*b* to cause extension of piston rods 68. By changing the pressure from one end of the cylinder 69 to the other, each of the piston rods 68 move axially in an out of its respective cylinder to move its respective latch pin up and down between a latched and unlatched position.

Referring to FIG. 7, a channel cover 84 is fastened to the channel 82 by passing screws (not show) through holes 86 into matching holes (not shown) in channel 82. Identical covers 74 are attached to the housing 74 on each side of the mounting plate 12. Both covers 74 and the cover 84 prevent dirt and debris from clogging up the operation of the latch pins 34 and the actuators 70.

Figure 3:
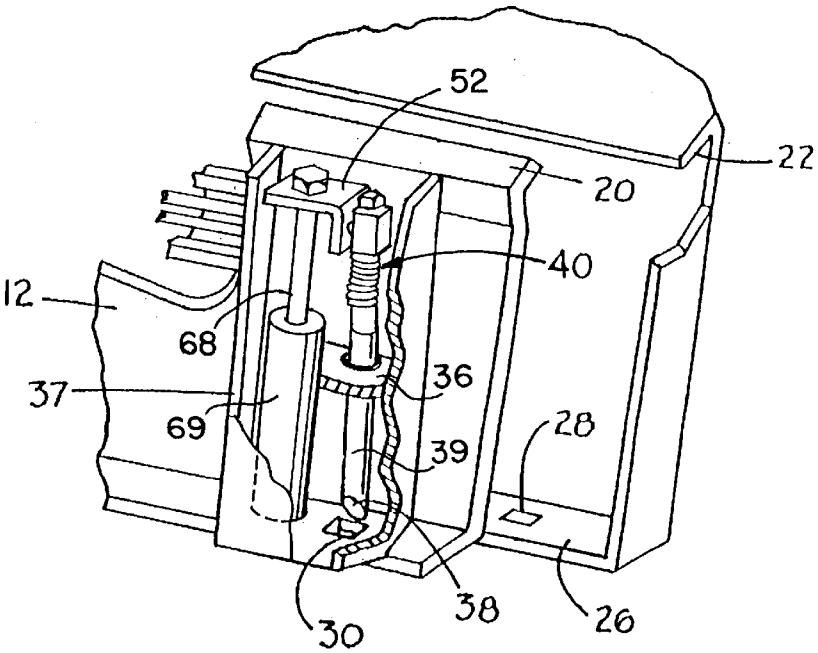
FIG. 3 is a fragmentary perspective view of one end of the mounting plate on the loader arms in position adjacent the attachment to be mounted.
Figure 5:
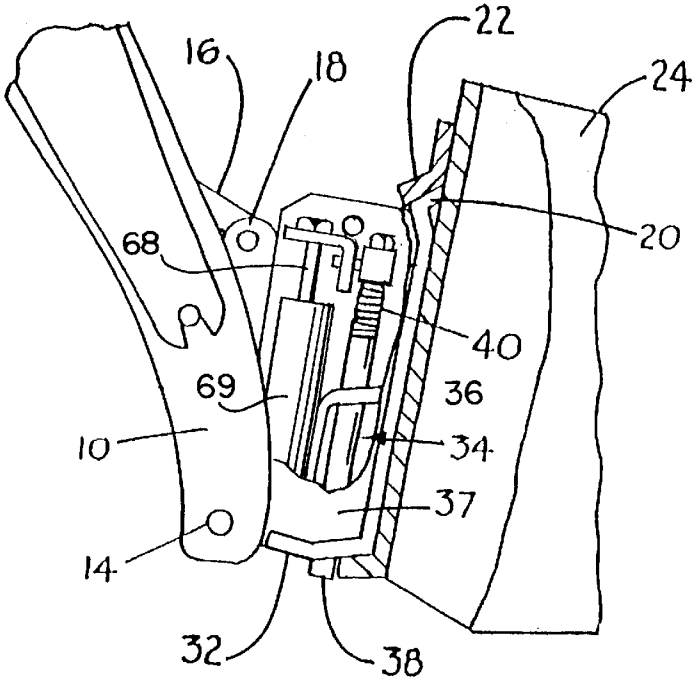
FIG. 5 is a side view of the attachment plate of the loader with parts in section and parts broken away to show the power actuator holding the latch pin in the extended position.
Figure 4:
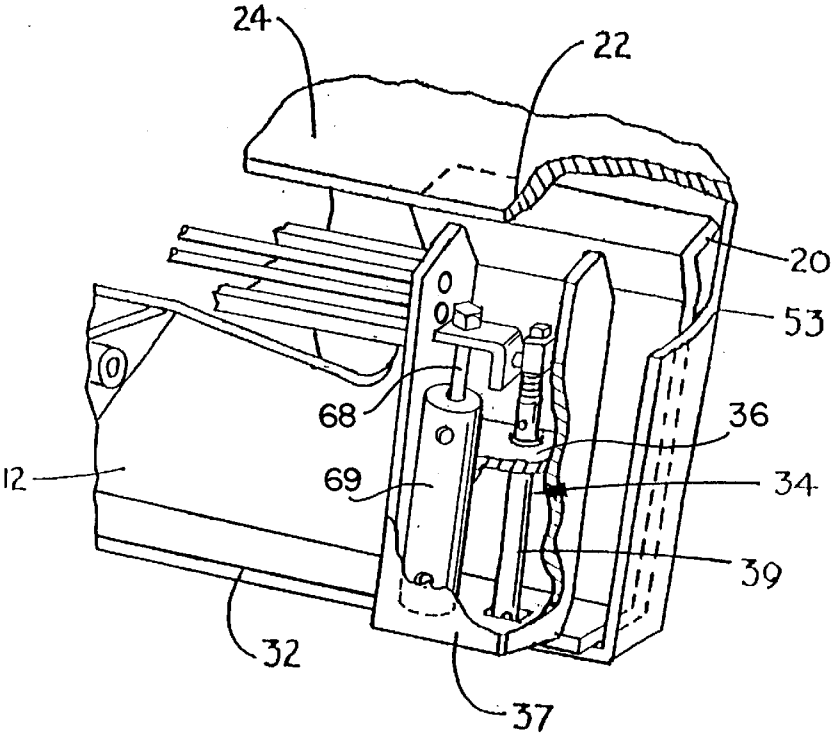
FIG. 4 is a fragmentary perspective view showing the attachment mounted on the plate, with a latch pin in an extended position to hold the attachment in place.

In operation, the piston rod 68 of each power actuator 70 is moved to an extended position, so that the latch pins 34 are moved to a raised unlatched position. The attachment frame 12 is moved from a position shown in FIGS. 2 and 3 to a position adjacent to the attachment 24 such as a loader bucket in the same manner as is done conventionally such as shown in FIGS. 4 and 5. The attachment frame 12 is tilted forwardly so that the lip 20 is placed under the attachment flanges 22. The rod 16 of the tilt cylinder on the skid steer loader is retracted and the bottom portion of the attachment frame will move into the receptacle formed above the lower flanges 26 on the attachment 24. The attachment frame 12 is positioned with the latch pins 34 aligned with the respective apertures 28 so that the latch pins 34 will be in position to lock in place.

Once the attachment frame 12 has been put into position relative to flanges 22 and 26, the piston rods 68 of the power actuators 70 can be retracted to extend to move the latch pins 34 downwardly to a latched position with the ends of the latch pins 34 being forced through the apertures 28 on the flange 28 of the attachment 24, to positively lock the attachment into position on the attachment frame 12. Then the loader can be used in the normal manner.

To release the attachment 24, the actuator 70 is operated in an opposite direction to extend the piston rods 68 and thereby retract the latch pins 34 to a raised unlatched position. The attachment frame 12 can then be tilted forwardly to pull the bottom portion of the frame 12 away from the flange 26. Lowering the attachment frame 12 will pull the lip 20 away from the flange 22 for complete release of the frame 12 from the attachment 24.

While the actuator 70 is shown as a hydraulic actuator, it could also be an electric actuator or other type device if desired. The term actuator as used herein means any type of power actuator that provides for extension and retraction under control of an operator to cause movement of the latch pins 34 between a latched an unlatched position. This actuator can be retrofited into existing equipment to replace hand lever operated latch pins.

Various other modifications can be made in the present invention without departing from the scope of the invention.

What is claimed is:

1. A power operated apparatus to latch a work implement to a loader arm of a skid steer vehicle comprising: an attachment frame pivotally attached to the loader arm and normally pivoted to a vertical position when supporting a work implement, the frame including a pair of spaced apart elongated vertical latch pins, each latch pin being slidably attached thereto near an opposite vertical end of the attachment frame from the other latch pin and slidable longitudinally from a raised unlatched position to a lowered latched position to hold the work implement on the attachment frame and a pair of power operated actuators, each actuator being vertically mounted in close parallel side by side relationship with one of the latch pins and having a fixed portion attached to the attachment frame and an elongated moveable portion having one end slidably engaging the fixed portion and an opposite end extending upwardly from the fixed portion and attached to an upper end of one of the respective latch pins to cause the latch pin to move to either a latched or unlatched position depending upon the direction of movement of the moveable portion, a power source associated with each actuator causing sliding movement of its respective moveable portion to an extended or retracted position with respect to its respective fixed portion and control means to regulate the power provided to both actuators.

2. The apparatus of claim 1 wherein each actuator comprises a hydraulically driven linear actuator.

3. The apparatus of claim 1 wherein the moveable member of each actuator is associated with the respective latch pin in such manner that when the moveable member moves to an extended position, it moves the latch pin to an unlatched position and when the moveable member moves to a retracted position, it moves the latch pin to a latched position to fasten a work implement to the attachment frame.

4. The apparatus of claim 1 including a cover means enclosing the latch pins and actuators to prevent dirt and debris from interfering with movement of the latch pins and actuators.

5. The apparatus of claim 4 wherein the cover means is removably attached to the attachment frame.

6. In a quick attachment device for attaching a work implement to an attachment frame mounted on loader arms of a vehicle, wherein said quick attachment device includes interlocking lips on the work implement and at an upper edge of the attachment frame and interfitting brackets on the work implement and on a lower edge of the attachment frame respectively and a vertical latch pin which fits into an aperture on the attachment frame and through an aligning aperture on the bracket on the work implement and which is slidably mounted on the attachment frame, the improvement comprising: a vertical power actuator associated with the latch pin in close parallel side by side relationship therewith to move the latch pin between a lowered latched and a raised unlatched position with respect to the work implement, the power actuator having an upwardly extending elongated slidable member having an upper end attached to an upper end of the latch pin.

7. The improvement of claim 6 wherein the actuator is a hydraulic driven linear actuator.

8. The improvement of claim 6 wherein the actuator has a moveable member which is associated with the latch pin in such manner that when the moveable member moves to an extended position it moves the latch pin to an unlatched position and when the moveable member moves to a retracted position it moves the latch pin to a latched position to fasten a work implement to the attachment frame.

9. The improvement of claim 6 including a cover means enclosing the latch pins and actuator to prevent dirt and debris from interfering with movement of the latch pin and actuator.

10. The improvement of claim 9 wherein the covers means is removably attached to the attachment frame.

11. The improvement of claim 6 including a latch pin position indicator associated with the latch pin to change position in response to axial movement of the latch pin, the latch pin position indicator being visible to the operator when in the cab of the vehicle when the latch pin is in the unlatched position.

12. The improvement of claim 11 wherein the latch pin position indicator protrudes through an opening in a cover enclosing the latch pin and actuator when the latch pin is in the unlatched position.

13. The improvement of claim 12 wherein the portion of the latch pin position indicator which protrudes from the cover is painted a bright color for easy visibility when the latch pin is in the unlatched position.

14. power operated apparatus to latch and unlatch a work implement to loader arms of a vehicle comprising an attachment frame connected to the loader arms, said attachment frame having a pair of laterally spaced apart elongated vertical latch pins that slidably move longitudinally up and down to either a lowered latched position extending through a hole in the work implement when positioned adjacent to the attachment frame or to a raised unlatched position withdrawn from the hole in the work implement, a pair of laterally spaced apart power actuators, with each actuator associated with a respective latch pin in close parallel side by side relationship therewith, each actuator having a fixed portion attached to the attachment frame and an elongated moveable portion having one end slidably engaging the fixed portion and an opposite end extending upwardly and attached to an upper end of the respective latch pins to cause the latch pins to move to either a latched or unlatched position, depending upon the direction of movement of the moveable portion, a power source associated with each actuator to provide power thereto to cause sliding movement of its respective moveable portion to an extended or retracted position with respect to its respective fixed portion and control means to regulate power provided to both actuators.

15. The apparatus of claim 14 wherein each actuator comprises a hydraulically driven linear actuator.

16. The apparatus of claim 14 wherein the moveable member of each actuator is associated with the respective latch pin in such manner that when the moveable member moves to an extended position, it moves the latch pin to an unlatched position and when the moveable member moves to a retracted position, it moves the latch pin to a latched position to fasten a work implement to the attachment frame.

17. The apparatus of claim 14 including a cover means enclosing the latch pins and actuators to prevent dirt and debris from interfering with movement of the latch pins and actuators.

18. The apparatus of claim 17 wherein the cover means is removably attached to the attachment frame.

19. The apparatus of claim 1 including a pair of vertical housings each being mounted near a vertical end of the attachment frame, each housing containing one of the vertical latch pins and one of the power actuators therein, the housing having a removable cover attached thereto to prevent dirt and debris from interfering with movement of the latch pins and actuators.

20. The apparatus of claim 1 wherein an upper end of the moveable portion of each actuator is attached to the upper end of one of the respective latch pins by an articulated connection.

21. The apparatus of claim 14 including a pair of vertical housings each being mounted near a vertical end of the attachment frame, each housing containing one of the vertical latch pins and one of the power actuators therein, the housing having a removable cover attached thereto to prevent dirt and debris from interfering with movement of the latch pins and actuators.

22. The apparatus of claim 14 wherein an upper end of the moveable portion of each actuator is attached to the upper end of one of the respective latch pins by an articulated connection.

* * * * *